US011078679B2

(12) United States Patent
Tournas et al.

(10) Patent No.: US 11,078,679 B2
(45) Date of Patent: Aug. 3, 2021

(54) UNIVERSAL SYSTEM TO MECHANIZE A COVER LIFTER ON A SPA TUB

(71) Applicant: HOT TUB PRODUCTS, LLC, Wallingford, CT (US)

(72) Inventors: Andrew Tournas, Branford, CT (US); Kyle Tournas, Prospect, CT (US); Jason M. DiMartino, New Britain, CT (US)

(73) Assignee: HOT TUB PRODUCTS, LLC, Wallingford, CT (US)

( * ) Notice: Subject to any disclaimer, the term of this patent is extended or adjusted under 35 U.S.C. 154(b) by 73 days.

(21) Appl. No.: 16/530,300

(22) Filed: Aug. 2, 2019

(65) Prior Publication Data

US 2021/0032887 A1 Feb. 4, 2021

(51) Int. Cl.
*E04H 4/08* (2006.01)

(52) U.S. Cl.
CPC ..... *E04H 4/084* (2013.01)

(58) Field of Classification Search
CPC ..... E04H 4/084
USPC ..... 4/498, 496, 494–495; 135/87; 220/216
See application file for complete search history.

(56) References Cited

U.S. PATENT DOCUMENTS 3,593,498 A * 7/1971 Semon ..... F24H 3/0405 96/141
5,048,153 A * 9/1991 Wall ..... E04H 4/084 16/223
5,131,102 A * 7/1992 Salley ..... B65F 1/1623 160/229.1
5,517,703 A * 5/1996 Ouelette ..... E04H 4/084 4/498
5,566,403 A * 10/1996 Black ..... E04H 4/084 220/264
5,634,218 A * 6/1997 Ouelette ..... E04H 4/084 4/498

(Continued)

FOREIGN PATENT DOCUMENTS

CA 2973274 A1 10/2018
EP 3392432 A1 10/2018

OTHER PUBLICATIONS

SpaEase 200 Hot Tub Cover Lifter sell sheet. Admitted Prior Art, Mar. 1, 2020.

(Continued)

*Primary Examiner* — Lori L Baker
(74) *Attorney, Agent, or Firm* — Gordon & Jacobson, P.C.

(57) ABSTRACT

A mechanized lifter system for retrofitting a manually operated lifer system includes a support located relative to the spa tub, a first mount rotatable on the support and defining a first pivot axis, at least one support element rotatable about the first pivot axis and attached to the first spa cover portion, a second mount on the support and defining a second pivot axis, an angle arm having a first portion and a second portion connected at a vertex, the first portion attached to the first mount and the second portion attached to the second mount, a support element bracket fixedly attached to the support element, a linear actuator configured to extend and retract and pivotally attached to the vertex of the angle arm and the support element bracket, and an actuator controller coupled to and configured to control extension and retraction of the linear actuator.

17 Claims, 10 Drawing Sheets

(56) References Cited

U.S. PATENT DOCUMENTS 5,644,803 A * 7/1997 Wilson ..... E04H 4/088 220/811
5,819,332 A * 10/1998 Perry ..... E04H 4/084 4/498
5,950,252 A * 9/1999 Fettes ..... E04H 4/084 4/498
5,974,599 A * 11/1999 Tudor ..... E04H 4/084 4/498
5,974,600 A * 11/1999 Pucci ..... E04H 4/084 4/498
6,000,071 A * 12/1999 Fettes ..... E04H 4/084 4/498
6,000,072 A * 12/1999 LaHay ..... E04H 4/084 4/498
6,032,305 A * 3/2000 Tedrick ..... E04H 4/084 220/817
6,158,063 A * 12/2000 Tudor ..... E04H 4/084 16/280
6,381,766 B1 * 5/2002 Perry ..... E04H 4/084 16/239
6,393,630 B1 * 5/2002 Tedrick ..... E04H 4/084 4/498
6,795,984 B1 * 9/2004 Brady ..... E04H 4/084 220/263
6,802,086 B1 * 10/2004 Hudzinski ..... E04H 4/084 4/498
7,155,756 B1 * 1/2007 Helder ..... E04H 4/084 4/498
7,290,297 B2 * 11/2007 Cunerty ..... A47K 3/001 248/286.1
7,461,415 B2 * 12/2008 Buzzetti ..... E04H 4/084 4/498
7,480,946 B1 * 1/2009 Brown ..... E04H 4/084 4/498
7,721,361 B1 * 5/2010 Shubert ..... E04H 4/108 4/498
8,239,977 B2 8/2012 Sloss
8,479,325 B2 7/2013 Gardenier et al.
8,516,625 B2 8/2013 Gardenier et al.
8,813,275 B2 * 8/2014 Genova ..... A61H 33/60 4/498
9,394,709 B2 * 7/2016 Iosim ..... E04H 4/084
9,593,498 B2 3/2017 Wyrick
10,273,702 B1 * 4/2019 Cunerty ..... A47G 25/12
2002/0050003 A1 * 5/2002 Perry ..... F16F 9/0254 4/498
2003/0131402 A1 * 7/2003 Katt ..... E04H 4/08 4/237
2003/0150054 A1 * 8/2003 Tudor ..... E04H 4/084 4/498
2004/0034915 A1 * 2/2004 Tedrick ..... E04H 4/084 4/498
2004/0055081 A1 * 3/2004 Wilson ..... E04H 4/084 4/498
2004/0143895 A1 * 7/2004 Loyd ..... E04H 4/084 4/498
2004/0154090 A1 * 8/2004 Perry ..... E04H 4/084 4/498
2005/0000010 A1 * 1/2005 Hagan ..... E04H 4/084 4/498
2005/0011001 A1 * 1/2005 Duarte ..... E04H 4/084 4/498
2005/0132486 A1 * 6/2005 Tedrick ..... E04H 4/084 4/498
2006/0053543 A1 * 3/2006 Vargas ..... E04H 4/084 4/498
2006/0200900 A1 * 9/2006 Dorsch ..... E04H 4/086 4/498
2006/0225197 A1 * 10/2006 Koren ..... E04H 4/084 4/498
2007/0017017 A1 * 1/2007 Piche ..... E04H 4/084 4/498
2007/0107118 A1 * 5/2007 Tudor ..... E04H 4/084 4/498
2007/0209103 A1 * 9/2007 Buzzetti ..... E04H 4/084 4/498
2007/0209104 A1 * 9/2007 Buzzetti ..... E04H 4/084 4/498
2007/0210290 A1 * 9/2007 Koren ..... E04H 4/084 254/264
2007/0220667 A1 * 9/2007 Kanetis ..... E04H 4/065 4/501
2007/0251000 A1 * 11/2007 Powell ..... E04H 4/08 4/498
2007/0256229 A1 * 11/2007 Duarte ..... E04H 4/084 4/498
2008/0184476 A1 * 8/2008 Albert ..... A47K 3/001 4/580
2008/0244820 A1 * 10/2008 Moore ..... E04H 4/108 4/498
2009/0049595 A1 * 2/2009 Muller ..... E04H 4/084 4/500
2009/0158517 A1 * 6/2009 Herd ..... E04H 4/103 4/499
2009/0165200 A1 * 7/2009 Kanetis ..... E04H 4/084 4/498
2010/0154111 A1 * 6/2010 Koren ..... E04H 4/084 4/500
2010/0170033 A1 * 7/2010 Adamczyk ..... E04H 4/084 4/503
2010/0313352 A1 * 12/2010 Sloss ..... E04H 4/084 4/498
2011/0048654 A1 * 3/2011 Kolar ..... E04H 4/084 160/188
2012/0066828 A1 * 3/2012 Kite ..... E04H 4/084 4/498
2012/0066829 A1 * 3/2012 Kite ..... E04H 4/084 4/580
2012/0137423 A1 * 6/2012 Gardenier ..... A61H 33/02 4/557
2012/0137424 A1 * 6/2012 Gardenier ..... A61H 33/02 4/557
2012/0137425 A1 * 6/2012 Gardenier ..... A61H 33/02 4/557
2012/0240324 A1 * 9/2012 Callahan ..... E04H 4/101 4/502
2013/0031713 A1 * 2/2013 Kite ..... E04H 4/084 4/498
2013/0104307 A1 * 5/2013 Genova ..... A61H 33/60 4/498
2014/0090163 A1 * 4/2014 Genova ..... E04H 4/084 4/498
2014/0201898 A1 * 7/2014 Spicer ..... E04H 4/084 4/498
2014/0289954 A1 * 10/2014 Wyrick ..... E04H 4/084 4/498
2015/0184410 A1 * 7/2015 Flores ..... E04H 4/084 4/498
2015/0204094 A1 * 7/2015 Spicer ..... E04H 4/084 4/498
2015/0204095 A1 * 7/2015 Tournas ..... E04H 4/084 4/493
2015/0345163 A1 * 12/2015 Cunerty ..... E04H 4/084 4/498
2016/0053505 A1 * 2/2016 Dose ..... E04H 4/084 4/498
2016/0123026 A1 * 5/2016 Genova ..... E04H 4/08 4/503
2016/0123027 A1 * 5/2016 Cunerty ..... E05F 1/1091 4/498
2016/0123028 A1 * 5/2016 Cunerty ..... E05F 1/1091 4/498
2016/0160519 A1 * 6/2016 Urness ..... E04H 4/084 4/498
2017/0121992 A1 * 5/2017 Spicer ..... E04H 4/084
2017/0284114 A1 10/2017 Gavin

(56) References Cited

U.S. PATENT DOCUMENTS

| | | | | |
|---|---|---|---|---|
| 2017/0292281 | A1* | 10/2017 | Hart | E04H 4/0037 |
| 2018/0230705 | A1* | 8/2018 | Spicer | F16B 7/182 |
| 2020/0240160 | A1* | 7/2020 | Spicer | E04H 4/084 |

OTHER PUBLICATIONS

PCT International Search Report and Written Opinion dated Dec. 17, 2020 of International Application No. PCT/US20/44239.

* cited by examiner

UNIVERSAL SYSTEM TO MECHANIZE A COVER LIFTER ON A SPA TUB

BACKGROUND

1. Field

The present disclosure relates to spa tubs. More particularly, this disclosure relates to cover lifter systems for spa tubs. Even more particularly, this disclosure relates to systems and kits that facilitate mechanized operation of the cover lifter systems.

2. State of the Art

Spa tubs are frequently used for relaxation, physical therapy, personal enjoyment, and for social occasions. One of the appealing attributes of a spa tub is that the tub includes jets that direct warm pressurized water toward an interior portion of the tub. Water that exits the jets and contacts the user's skin can create a massaging effect that is pleasurable, and even rehabilitative.

Spa tubs come in two forms: permanent in-ground installations and 'portable' above-ground installations. Portable spa tubs include a frame that supports a molded tub shell, and a cabinet surrounding the frame. The tub shell has an upper boundary rim, a plurality of seating locations defined by seat bottoms and backs and reclining lounges, and a lower floor. At one or more of the seating locations hydrotherapy jets are installed and a suction fitting is provided near the floor. Between the spa shell and the cabinet, a space is defined in which plumbing and manifolds are provided to connect the jets, as well as one or more water pumps that circulate the water and a heater that heats the water circulated by the water pumps.

Referring to prior art FIGS. 1*a* and 1*b*, for purposes of energy efficiency and readiness of use, it is common to provide the spa 10 with an insulative cover 12 that limits heat loss from the water when the spa is not in use. The covers of most such spas include first and second portions 14, 16 of equal size that together are sized to seat on and cover the upper rim 18 of the spa tub shell 20. Each of the first and second portions 14, 16 are constructed of insulative foam slabs provided within a water-resistant vinyl casing material. The second portion 16 is movable relative to the first portion 14 on a living hinge 22 that connects the first and second portions at their opposing inside upper corners 24, 26 so that the first portion 14 can be folded back over the second portion 16 (FIG. 1*b*). The hinge 22 is constructed of the same vinyl material as the casing material.

A cover lifter 30 includes side members 32 (on both sides of the cover 12) connected to a bar 34 that seats on the cover 12. The side members extend from the bar 34 to hinges 36 that define an axis A about which the lifter 30 is rotatable. The bar 34 extends over the hinge 22 so that the second portion 16 can be folded back onto the first portion 14. The lifters for covers are provided in manual and mechanized types. Using a manual lifter to remove the spa cover 12, the second portion 16 is folded back onto the first portion 14. Then, the user rotates the bar 34 about a rotation axis (denoted A in FIG. 1*b*) to lift the first and second portions 14, 16 of the cover 12 together off of the rim of the spa tub 10. A gas spring is often provided to exert a force that reduces the manual force required to rotate lift the bar 34 and cover 12.

Common mechanized lifters similarly provide a bar over the hinge. However, the mechanized lifter often replaces the gas spring with a gear train or a linear actuator. In operation, the user initially manually folds the second portion back onto the first portion. Then, the user actuates a controller to cause the gear train to rotate or the linear actuator to change length and consequently rotate the bar and result in lifting of the cover completely off of the spa tub.

Another type of spa cover and lifter is described in co-owned U.S. Pat. Nos. 8,479,325 and 8,516,625 and shown in FIGS. 2*a* and 2*b*. The cover includes first and second portions each of a different size, and a hinge that seats on the upper rim of the spa tub. The first and second portions, and the hinge define a heat-sealing edge about the rim of the spa tub when the cover is closed. The lifter includes a mount positionable relative to the spa tub. A first support element of the lifter is rotatable about a pivot axis and is connected to the first portion.

In use, when the cover is fully closed, the user applies a lifting force on the first support element, causing the first cover portion to start to lift off the spa tub rim, and pull the second cover portion towards it into an angled configuration about the hinge and relative to the first cover portion. There are no known practical mechanized systems for such a lifter.

SUMMARY

In accordance with an aspect of the disclosure, methods, kits, and systems are provided for modifying, retrofitting, or otherwise improving a preexisting spa tub cover lifter system for use in association with a preexisting spa tub. The spa tub is provided with a spa tub cover. The spa tub cover has a first portion including a heat insulative material surrounded by an at least water resistant covering. The first portion has a first lower surface that faces the water and an opposed first upper surface. The spa tub cover has a second portion including a heat insulative material surrounded by an at least water resistant covering. The second portion has a second lower surface that faces the water and an opposed second upper surface. The first and second portions are rotatable relative to each other on a hinge about a hinge axis between a flat configuration and a folded configuration, and when in the flat configuration, the first and second lower surfaces are co-planar. The preexisting lifter system of the spa tub to be modified includes i) a support located relative to the spa tub, ii) a first mount rotatable on the support and defining a first pivot axis, iii) at least one support element rotatable about the first pivot axis and attached to the first spa cover portion, iv) a second mount on the support and defining a second pivot axis, and v) a pneumatic cylinder, piston, or spring pivotally attached to the at least one support element and the second mount.

The retrofit kit includes an angle arm configured to attach to the support, a support element bracket configured to fixedly attach to the support element, a linear actuator configured to extend and retract and configured to pivotally attach to the angle arm and the support element bracket, and an electrically powered actuator controller configured to control extension and retraction of the linear actuator. The method includes configuring the cover so that the first and second portions are in the flat configuration, and providing the kit. The method also includes disconnecting the pneumatic cylinder, piston, or spring from the at least one support element and the second mount, and securing the angle arm to the first mount and the second mount. Also, the method includes securing the support element bracket to the support element, pivotally connecting the linear actuator to the angle arm and to the support element bracket, and mounting the actuator controller to the spa tub.

In embodiments, the angle arm includes a first portion and a second portion extending from a common vertex at a fixed nonzero angle relative to one another. The first portion extends from the vertex to a first end and the second portion extends from the vertex to a second end, and the vertex defines a third pivot axis not present in the prior cover lifter system. Securing the angle arm to the first mount and the second mount includes attaching the first end of the first portion to the first mount and attaching the second end of the second portion to the second mount so that the vertex is disposed horizontally between the first and second mounts and between the first and second axes and the vertex is disposed vertically below the first axis.

In embodiments, pivotally connecting one of the linear actuators includes pivotally connecting an end of the linear actuator to the vertex of the angle arm for rotation of the linear actuator about the third pivot axis.

In embodiments, mounting the actuator controller includes disposing the actuator controller in a space between an inner tub shell of the spa tub and an outer cabinet of the spa tub.

In embodiments, the kit includes providing a remote controller configured to control the actuator controller. The remote controller and actuator controller can communicate with one another via a wired or wireless connection.

Also, in embodiments, the kit includes providing two angle arms configured to attach to respective supports on opposite sides of the spa tub, two support element brackets configured to fixedly attach to support elements on opposite sides of the spa tub, two linear actuators configured to pivotally attach to corresponding angle arms and support element brackets on opposite sides of the spa tub. The actuator controller is also configured to operate the two linear actuators in unison.

In embodiments, the linear actuator is in a partially or fully retracted position when performing the step of pivotally connecting the linear actuator to the angle arm and the support element bracket.

In embodiments, the linear actuator is configured to extend or retract when power is applied to the linear actuator and wherein the linear actuator is configured not to extend or retract when power is not applied to the linear actuator.

In accordance with another aspect of the disclosure, an improved spa tub system is provided for use in association with a spa tube having the aforementioned spa tub cover. The improvement includes a lifter system having a support located relative to the spa tub, a first mount rotatable on the support and defining a first pivot axis, at least one support element rotatable about the first pivot axis and attached to the first spa cover portion, a second mount on the support and defining a second pivot axis, an angle arm having a first portion and a second portion connected at a vertex, the first portion attached to the first mount and the second portion attached to the second mount, a support element bracket fixedly attached to the support element, a linear actuator configured to extend and retract and pivotally attached to the vertex of the angle arm and the support element bracket, and an actuator controller coupled to and configured to control extension and retraction of the linear actuator.

According to another aspect of the disclosure, a method of operating the improved spa tub cover lifting system includes receiving a control signal at the actuator controller to open the cover, and in response to receiving the control signal, automatically applying power to the linear actuator to cause the linear actuator to extend to cause the at least one support element to rotate about the first pivot axis and thereby lift the cover off of the spa tub.

In embodiments, the method includes receiving a control signal at the actuator controller to close the cover, and in response to receiving the control signal, automatically applying power to the linear actuator to cause the linear actuator to retract to cause the at least one support element to rotate about the first pivot axis and thereby lower the cover onto the spa tub. In embodiments, the method may include manually guiding the cover onto the spa as it is being lowered into the closed position.

BRIEF DESCRIPTION OF THE DRAWINGS

Prior art

Prior art

Prior art

Prior art

Prior art

Prior art

Prior art

Prior art

DETAILED DESCRIPTION

Figure 2A:
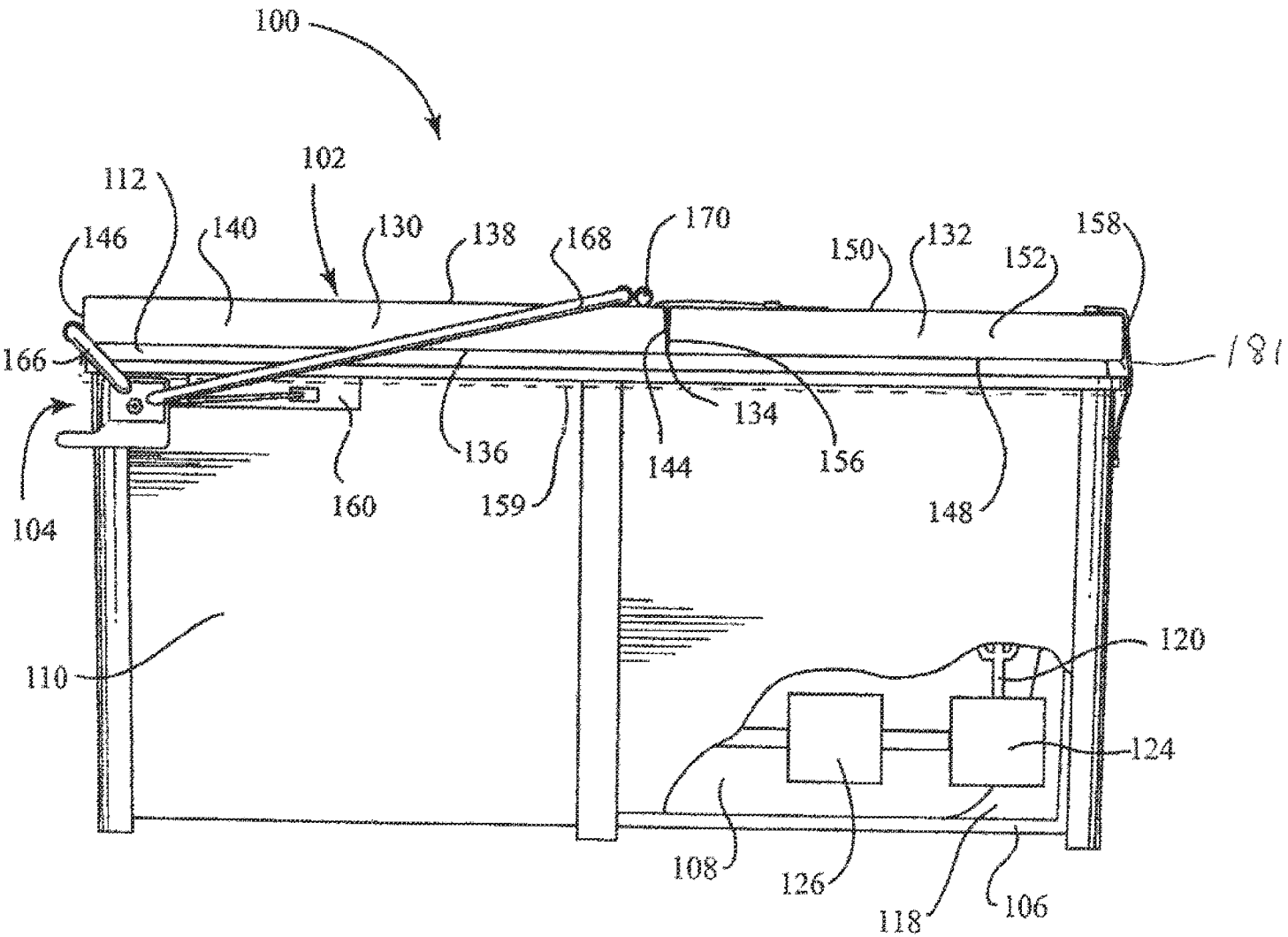
FIG. 2A (Prior Art)
FIG. 2*a* is a side elevation view of a spa tub provided with a prior art insulative cover and lifter system, shown in a closed position.
Figure 2B:
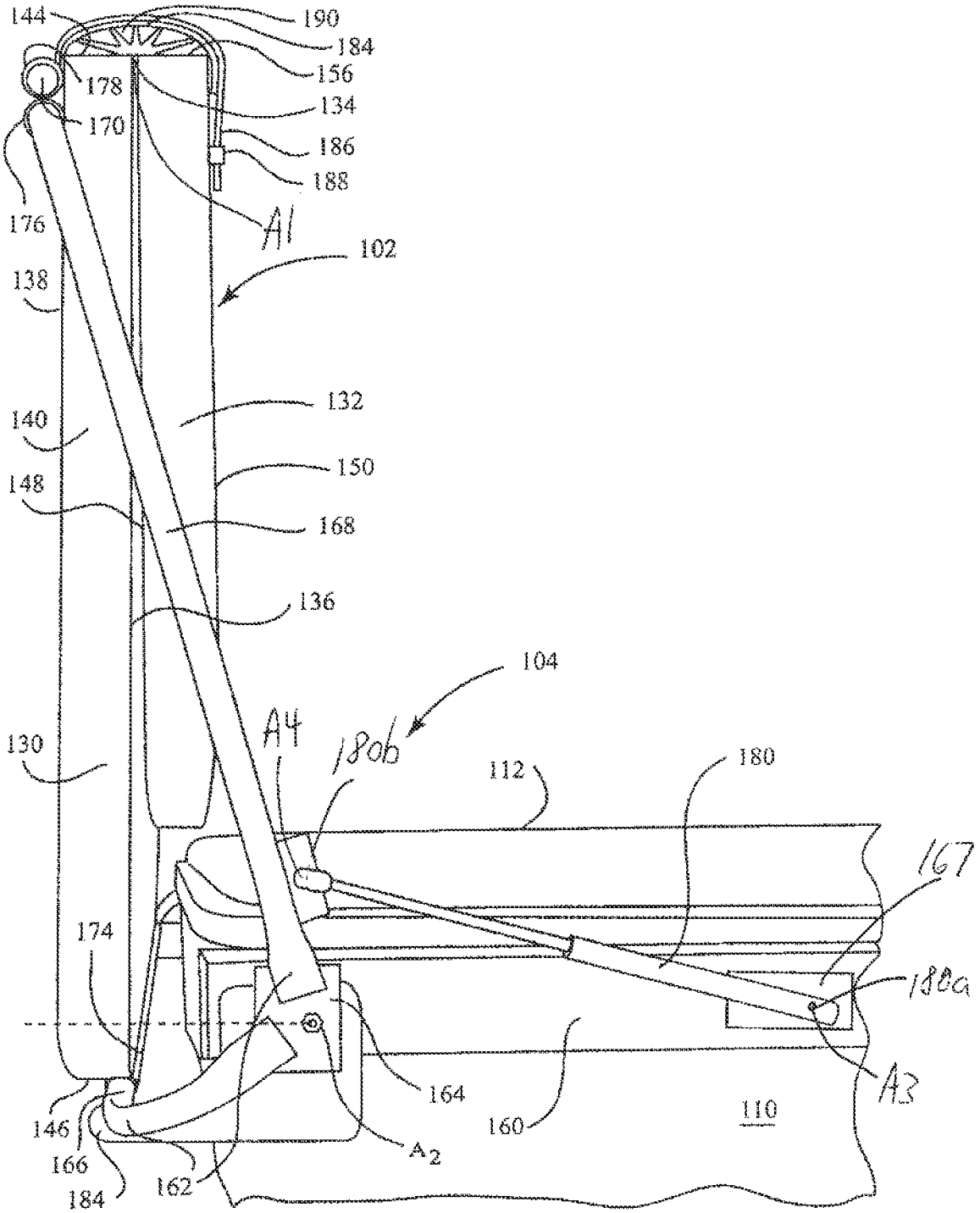
FIG. 2B (Prior Art)
FIG. 2*b* is a side elevation view of the spa tub in FIG. 2*a*, shown in an open position.

Turning now to FIGS. 2*a* and 2*b*, an example of a preexisting portable spa tub 100 to be retrofitted is provided with a spa tub cover 102 and a lifter 104 for raising the tub cover relative to the tub so that the tub may be used. The portable spa tub 100 includes a frame 106 that supports a molded tub shell 108, and a cabinet 110 surrounding the frame. The tub shell 108 has an upper boundary rim 112 (FIG. 2*b*), a plurality of seating locations (not shown) defined by seat bottoms and backs and reclining lounges, and a lower floor. At one or more of the seating locations hydrotherapy jets are installed and a suction fitting (not shown) is provided near the floor. Between the spa shell 108 and the cabinet 110 a space 118 is defined in which manifolds and other plumbing 120 are provided to connect the jets, as well as one or more water pumps 124 that circulate the water, and a heater 126 that heats the water circulated by the water pumps.

The spa cover 102 includes first and second rectangular portions 130, 132 which together are sized to seat on and cover the upper rim 112 of the spa tub shell 108. The first and second portions 130, 132 are coupled together at a hinge 134, as described in more detail below. Each of the first and second portions 130, 132 is constructed of an insulative slab (e.g., a foam slab that has low transmission of heat energy, especially with respect to water heated to a temperature of between 75° and 110°) provided within an at least water-resistant, and more preferably waterproof, casing material such as vinyl.

Figure 2C:
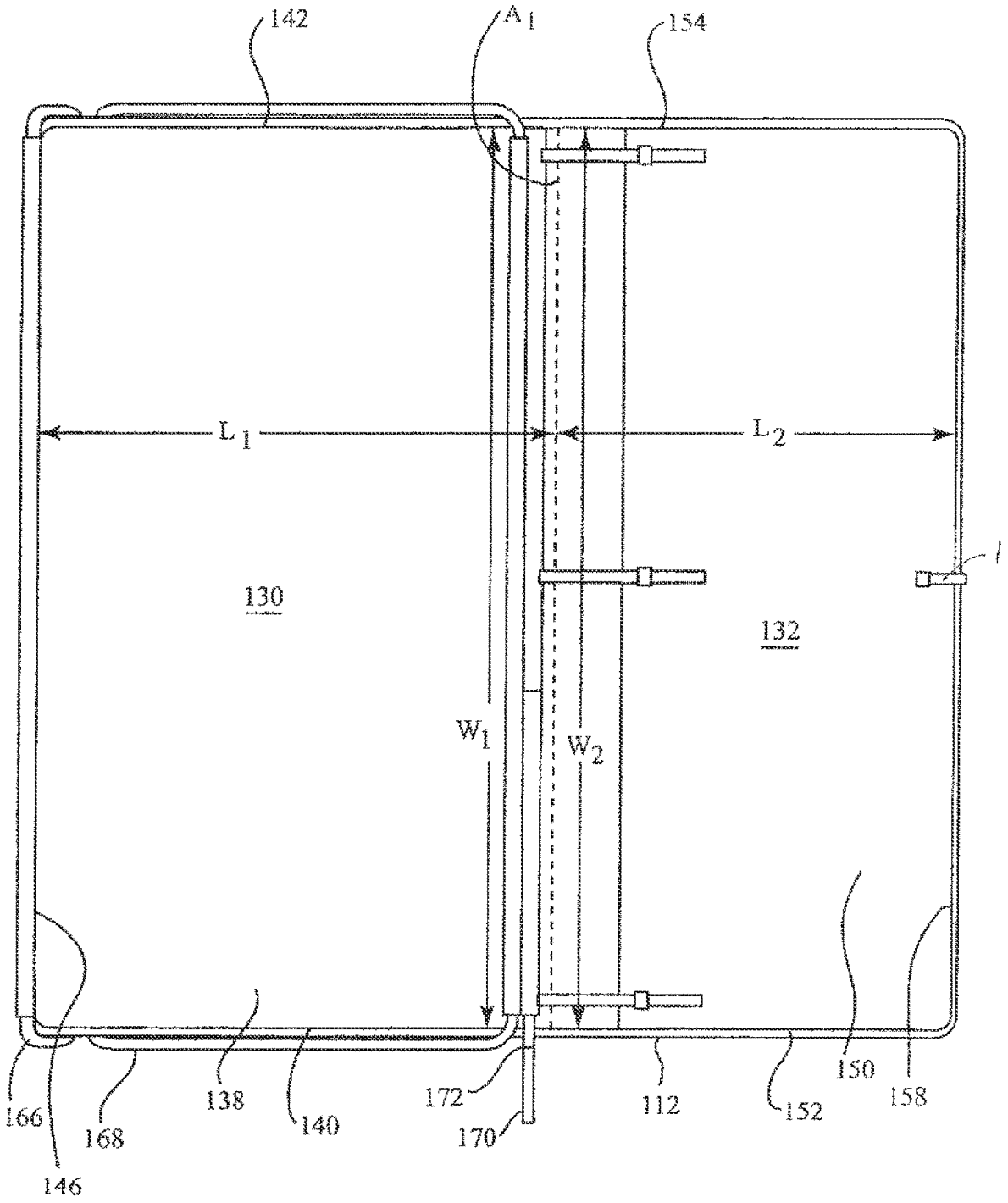
FIG. 2C (Prior Art)
FIG. 2*c* is a top view of the spa tub shown in FIG. 2*a*.

The first portion 130 of the spa cover has a first lower surface 136 that faces the water in the spa tub 100 and an opposed first upper surface 138. Lateral sides 140, 142 extend between the first lower and first upper surfaces 136, 138. The lateral sides 140, 142 also extend transverse to the first lower surface 136 in a lengthwise dimension. The first portion 130 also includes an inner side 144 extending transverse to both the first lower surface 136 and the lateral sides 140, 142, as well as an outer side 146 extending parallel to and facing opposite the inner side 144. The inner side 144 extends in a widthwise dimension between the lateral sides 140, 142. A first length L1 (FIG. 2*c*) is defined as the distance between the inner side 144 and the outer side 146. A first width W1 (FIG. 2*c*) is defined as the distance between lateral sides 140, 142 along the inner side 144.

The second portion 132 of the cover includes corresponding surfaces to the first portion 130, with a second lower surface 148 that faces the tub water and an opposed second upper surface 150. Lateral sides 152, 154 extend between the second lower and upper surfaces 148, 150 in a lengthwise dimension. An inner side 156 extends transverse to the second lower surface 148 in a widthwise dimension between the lateral sides 152, 154. The inner side 156 of the second portion faces the inner side 144 of the first portion. The second portion 132 also includes an outer side 158 extending between the first and second lateral sides 152, 154 and facing opposite the inner side 144 of the first portion. A second length L2 (FIG. 2*c*) is defined as the distance between the inner side 156 and the outer side 158. A second width W2 (FIG. 2*c*) is defined as the distance between lateral sides along the inner side 156. In one embodiment, the first and second widths W1, W2 are the same, and the first length L1 is greater than the second length L2. The reasons that length L1 is greater than length L2 is described below.

The hinge 134 that couples the first and second portions 130, 132 has a pivot axis A1 that extends along the first and second portions in a direction parallel to the widthwise dimension defining W1 and W2. The hinge 134 is preferably a living hinge connected to the lower surfaces 136, 148 of the first and second portions. When the cover 102 is in a flat 'closed' configuration (as shown in FIG. 2*a*), the first and second lower surfaces 136, 148 are co-planar and seat adjacent one another on the upper rim 112 of the spa tub 100. Because the hinge 134 is preferably provided as a living hinge of the same vinyl material of the first and second portions and because the hinge 134 is provided at the lower surface, an unbroken, gapless seal (preferably air tight) is provided about the entirety of the rim, without the space for heat loss that results from prior art covers. Preferably, a flexible skirt 159 also extends about the perimeters of the first and second lower surfaces to further reduce the opportunity for heat loss and to protect the molded spa tub from the sun when not in use. For purposes of clarity, the skirt 159 is not shown in several of the figures; nevertheless it is preferably present in all embodiments. However, given that the hinge is at the lower surface, the methods of opening and removing a spa cover which are used in the prior art cannot be used with the cover of the invention, and another method is provided as described hereinafter. Referring to FIG. 2*b*, when the cover 102 is moved into a folded 'open' configuration, the lower surfaces 136, 148 which face the water when in the closed configuration and can be unsightly, are moved into a position in which they face each other, whereas the upper surface 150 of the second portion faces the users in the tub 100 and opposite upper surface 136. The lengths L1 and L2 are different to allow the spa cover to be folded and raised up; given the manner of folding and raising, if the lengths L1, L2 were equal the second portion 132 would be too long to rotate into a vertical position with the relatively small profile lifter and about a pivot axis located on the spa cabinet. Given that the first and second portions 130, 132 have different lengths L1, L2 (maximum dimension transverse to the hinge pivot axis A1), when the cover 102 is in the open configuration, the first and second outer sides 146, 158 are longitudinally displaced from one another such that they are not coplanar.

The lifter 104 facilitates lifting the cover 102 from the closed configuration (FIG. 2*a*) to the open configuration (FIG. 2*b*). More particularly, the lifter 104 couples to the first portion 130 of the cover in a fixed relation; i.e., the first portion 130 cannot freely swing or otherwise move relative to the lifter. Referring specifically to FIG. 2*b*, the lifter 104 is coupled to the spa tub 100 with one or more brackets 160 that are attached directly to the spa tub 100, such as at the frame and cabinet 110 as shown. In the embodiment of the lifter 104 shown in the figures, two brackets 160 are provided on opposite sides of the spa tub 100, but only one bracket 160 is visible. It is appreciated that the second bracket 160 is a mirror image of the first bracket 160. The second bracket 160 is optional and a single first support of sufficient structure and stability can be used.

A lifter frame 162 may be coupled to the brackets 160 at mounts 164 rotatable about a common pivot axis A2. The lifter frame 162 includes a U-shaped outer member 166 which extends across the outer side 146 of the first portion 130 and to the mounts 164, and a U-shaped upper member 168 that extends along the lateral sides 140, 142 of the first portion at an oblique angle relative to the lower surface 136 and across the upper surface 138 of the first portion in proximity to the inner side 144 (FIG. 2*b*) and to the mounts 164. Alternatively upper member 168 can extend along one of the lateral sides 140 and along none of, or only a small portion of the upper surface 138 and to the mounts 164.

The lifter frame 162 also includes a handle member 290 that extends or is extendable laterally outward from the spa tub 100 to facilitate movement thereof and may be integrated with or distinct from the upper member 168. The handle 290 may be connected to or integrated with the upper member 168, fixed in position relative to the upper member 168, or may movable relative to the upper member 168 so that the handle 290 does not protrude relative to the sides of the spa tub 100 when not in use. By way of example, the handle 290 may be coupled to a hinge 172 that permits it to fold relative to the frame or may telescope into a recessed position.

Referring to FIG. 2*b*, in order to couple the lifter 104 to the first portion 130 of the spa cover 102, one embodiment of the first portion 130 of the cover 102 includes a plurality of sleeves, loops, pockets, ties, hook and loop straps, or other suitable structure at which the lifter 104 can be coupled. For example, a first sleeve 174 is provided at the outer side 146 of the first portion 130 and receives the outer member 166 of the frame 162, a second sleeve 296 is provided along the upper surface 138 and receives the upper member 168 of the frame 162, and a third sleeve 178 is provided adjacent the second sleeve 296 and receives the handle 290.

Pneumatic cylinders 180, pistons, springs (e.g., metal or gas) are located on opposite sides of the spa tub 100 and are connected to corresponding brackets 160. Each cylinder 180 extends between a first end 180*a* and a second end 180*b* that is linearly displaceable relative to the first end 180*a*. The first end 180*a* is pivotally connected to a mount 167 of each bracket 160, and the second end 180*b* is pivotally connected to the upper member 168 of the frame 162 to limit the amount of human effort required to lift the cover 102. The first end 180*a* is configured to rotate about axis A3, which is spaced (e.g., horizontally) from axis A2 across the bracket 160. The second end 180*b* is configured to rotate about axis A4. The cylinder 180 stores potential energy in the closed compressed configuration and imparts force through kinetic energy when allowed to expand. The cylinder 180 assists in smoothly rotating the spa cover 102 back and forth between the closed and open configurations. Further, the cylinder 180 assists moving the spa cover 102 from the open configuration into the closed configuration by preventing the cover 102 from rotating too quickly which could otherwise occur, e.g., due to a lack of sufficient user strength to control such smooth closure or slippage of the handle 290 from a user's grip. It is preferable that the cylinder 180 be coupled to the upper member 168 and oriented such that once the cover 102 is rotated even a relatively small angular displacement about axis A2 (e.g., 10°-25°) from the open configuration toward the closed configuration, the cylinder 180 operates as a closure assist, with such closure compressing the cylinder gas and thereby gradually lowering the cover 102 into the closed configuration. Moreover, because the cover 102 is fixed in position relative to the frame 162 cover at support bars 166, 168 and always referenced relative to the pivot axis A2, in distinction from other covers which can slide around relative to their manually activated lifting mechanisms, the cover 102 is always referenced relative to the spa rim to automatically ensure a complete seal about the rim each time it is moved to the closed configuration.

Figure 3:
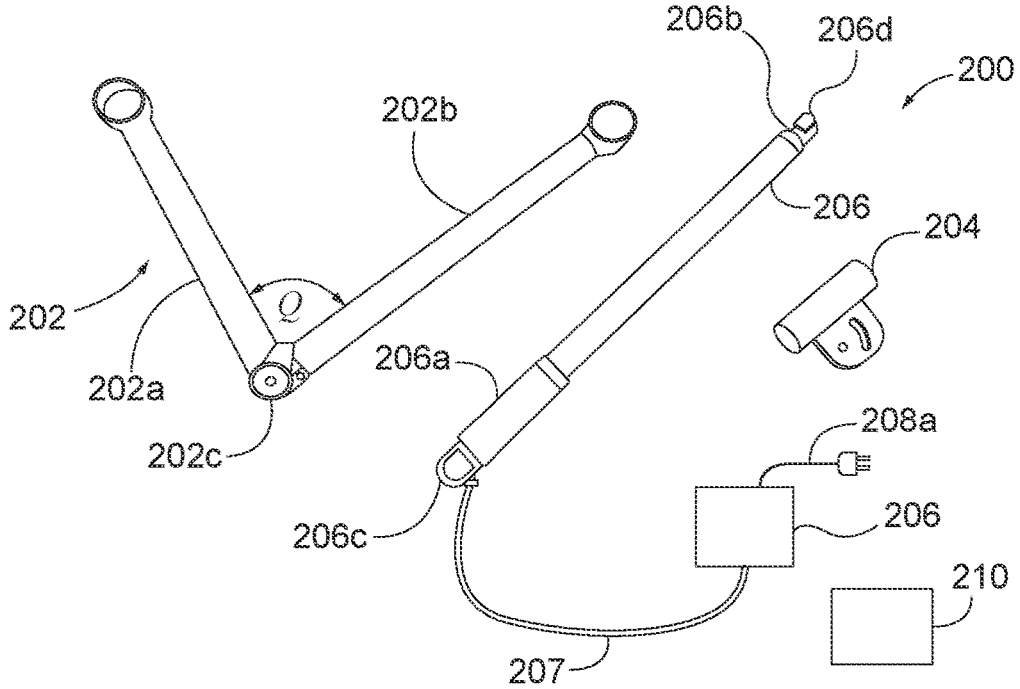
FIG. 3 illustrates portions of a kit in accordance with an aspect of the disclosure.
Figure 4:
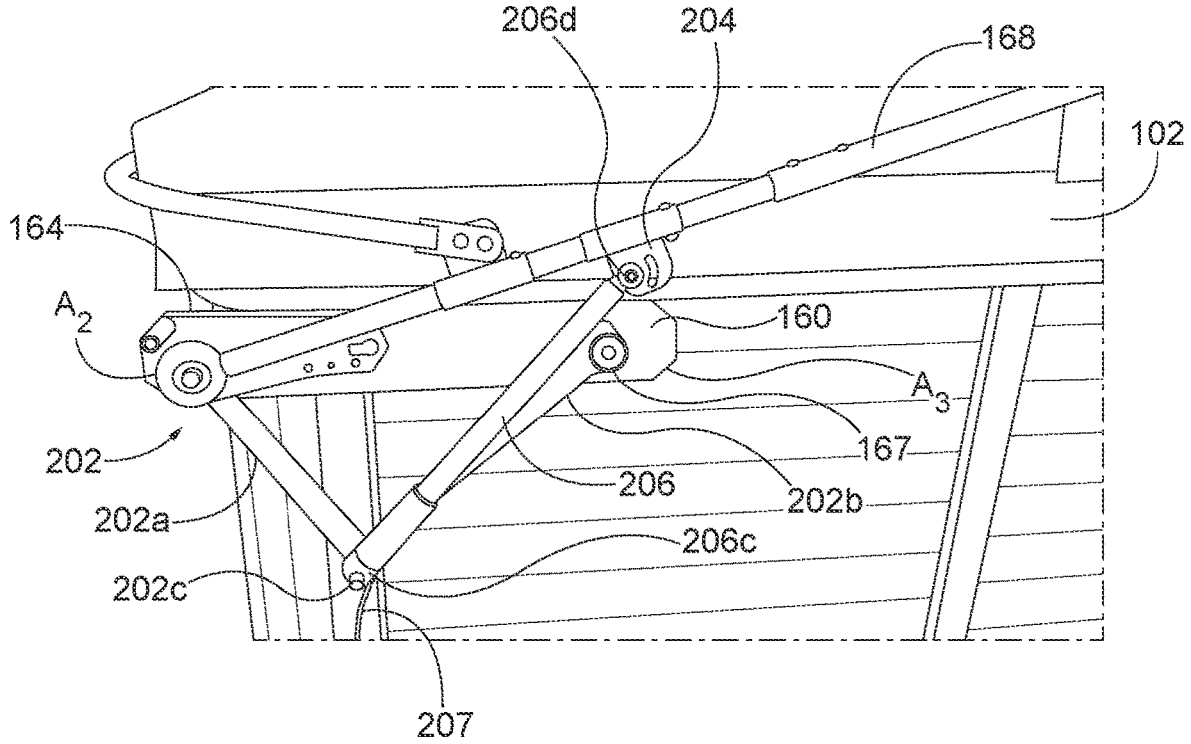
FIG. 4 is view of a portion of the spa tub of FIG. 2*a* retrofitted with the kit of FIG. 3 with the cover in a closed position.

The lifter 104 described above is a manually operated lifter that can be assisted by the cylinders 180. In accordance with an aspect of the disclosure, the lifter 104 described above can be retrofitted or otherwise modified with a kit 200, components of which are shown in FIG. 3, and described below to automate the operation of the lifter 104 to open and close the cover 102. FIG. 4 shows the kit 200 installed on the tub 100.

In one embodiment, the kit 200 includes two L-shaped angle arms 202 (one corresponding to each bracket 160; only one shown in FIG. 3), two lifter arm brackets 204 (one corresponding to each bracket 160; only one shown in FIG. 3), two electronic linear actuators 206 (one corresponding to each bracket 160; only one shown in FIG. 3), and an actuator controller 208 that controls the operation of the actuators 204 to act in unison. Specifically, as will be described below, in accordance with one embodiment, the same parts of the lifter 104 on opposite sides of the tub 100 will be retrofitted, requiring one L-shaped arm 202, one lifter arm bracket 204, and electronic linear actuator 206 on each side of the tub 100. In some applications where the cover 102 is relatively small or lightweight in relation to the strength of the linear actuator 206, it may be possible to retrofit a spa tub with only one angle arm 202, one lifter arm bracket 204, and one linear actuator 206 from the kit 200. Thus, it will be appreciated that in some embodiments, the kit 200 may include one L-shaped angle arm 202, one lifter arm bracket 204, one electronic linear actuator 206, and one actuator controller 208.

The angle arm 202 has a first portion 202*a* and a second portion 202*b* that extend from a common vertex 202*c* at a fixed non-zero angle θ relative to one another. The first and second portions 202*a*, 202*b* may be of unequal length, as shown in FIG. 3. The angle arm 202 is configured to be secured or otherwise affixed to the bracket 160 at mount 164 and mount 167. Specifically, in the embodiment shown in FIGS. 3 to 6, the first portion 202*a* extends from the vertex 202*c* to an open boss that is configured to securely connect to mount 164 (e.g., at axis A2), as shown in FIG. 4. The second portion 202*b* extends from the vertex 202*c* to an open boss that is configured to securely connect to mount 167 (e.g., at axis A3), as shown in FIG. 4. Thus, the angle arm 202 is configured to attach to preexisting locations of the bracket 160. The vertex 202*c* has a boss that defines an axis A3 and is configured to be spaced apart from the cabinet of the tub when the arm 202 is connected to the bracket 160. Also, when connected to the bracket 160 and when the cover is between the closed and open positions, the vertex 202*c* is located horizontally between axes A2 and A3, and vertically below axis A2, as shown in FIG. 4.

The linear actuator 206 includes a housing 206*a* that houses an electric drive (not shown) and a moveable shaft 206*b*. The electric drive is configured to linearly extend and retract the shaft 206*b* with respect to the housing 206*a*, as is known in the art. The linear actuator 206 extends between a first end 206*c* on the housing 206*a* and a second end 206*d* on the shaft 206*b*. The length of the actuator 206 can be operatively increased (to open the cover 102) and decreased (to close the cover 102) by operation of the electric drive. As noted above, the first end 206*c* of the actuator 206 is pivotally connected to the angle arm 202 at the vertex 202*c*, as shown in FIG. 4. The second end 206*d* of the actuator 206 is pivotally connected to the bracket 204, as shown in FIG. 4.

The bracket 204 is configured to be securely affixed to the upper member 168 (such as with mechanical fastening means), as shown in FIG. 4. The location along the side member 168 at which the bracket 204 is secured may depend on the range of length of the linear actuator between its fully retracted and fully extended positions, the point of intersection between the linear actuator 206 and the upper member 168 when the cover 102 is in the closed position, and on physical constraints of the upper member 168 that might obstruct the positioning of the bracket 204 in certain locations along the length of the upper member 168. Also, the location of the bracket 204 on the upper member 168 may also depend on the strength of the linear actuators 206 and the need to exert a sufficient torque about axis A2 to move the cover from a closed position to an open position. Thus, it may be beneficial to maximize the distance between axis A2 and the position of the bracket 204 on the upper member 168 to maximize the moment arm about which the force of the actuator 206 is exerted to maximize mechanical leverage. In some instances it may be necessary to partially extend the actuator 206 so that it can reach the bracket 204 affixed to the upper member 168.

The linear actuator 206 is configured to receive electrical power from the actuator controller 208 via a wire connection 207 between the linear actuator 206 and the controller 208, which may reside in the space 118 in the cabinet. In some embodiments, the linear actuator 206 and the actuator controller 208 may be co-located or integrated so that a separate actuator controller 208 need not be mounted separately from the linear actuator 206. As shown in FIG. 4, the controller 208 may have power wiring 208*a* for connection to a power supply (e.g., AC or DC power supply), and the controller 208 may route electrical power (e.g., AC or DC) through the wired connection 207 to the linear actuator 206.

The actuator controller 208 is communicatively coupled to a remote controller 210, either through a wired or wireless connection. The remote controller 210 is spaced remotely from the actuator controller 208, although the remote controller 210 may be physically connected to the tub. For example, the remote controller 210 may be a touchpad or other switch attached to or integrated into the cabinet and may be wired directly to the actuator controller 208. Alternatively, the remote controller 210 may be physically separable from the cabinet and may be a handheld wireless remote control having one or more buttons corresponding to command the actuator controller 208 to actuate the actuator 206 to open or close the cover 102. Specifically, the remote controller 210 is configured to send commands or signals to the actuator controller 208 to open or close the cover 102, which in-turn, powers the actuators 206 to either extend or retract the shaft 206*b*. In one embodiment, a smart phone may be configured (e.g., by running a dedicated application) as the remote controller 210 to communicate with the actuator controller 208 to operate the opening and closing of the cover. The remote controller 210 and the actuator controller 208 may communicate via any wired or wireless communication protocol, such as RF, IR, wi-fi, TCP/IP, CANBUS, and Bluetooth.

In one embodiment where two actuators 206 are used, the actuator controller 208 is communicatively coupled to both actuators 206 on opposite sides of the tub 100 so that both actuators 206 operate simultaneously in unison to raise and lower the cover 102. The linear actuators 206 are configured so that the shaft 206*b* can be stopped in any extended or retracted position and the shaft will not freely move from the stopped position even when power is not applied. Thus, the cover 102 will remain in any position between fully open and closed even when power is not supplied to the actuators 206. This can protect from unwanted closure when the cover 102 is opened, such as by someone accidentally pushing on the cover. Also, this can protect from unwanted opening of the cover 102 when the cover 102 is in the closed position.

In the event of power loss or damage to the linear actuator(s) 206, the kit 200 may also be temporarily disabled to revert back to manual operation of the lifter 104, although without the assistance of the cylinder 180. For example, if necessary to open or close the cover during a loss of power, a user can disconnect the actuator 206 at end 206*c* and/or 206*c*. Also, in the event that a service technician needs to open or close the cover and the remote controller 210 is unavailable to the technician, the controller 208 is configured to be manually overridden by the technician through an interface of the controller 208. The interface may include a set of physical switches located on or inside the controller 208 (e.g., accessible under a cover of an enclosure of the controller). Also, the interface may be a wired or wireless communication interface accessible by a technician having a dedicated controller.

As shown in FIG. 4, the kit 200 substitutes for the pneumatic cylinders 180 and connects to the same bracket 160 and upper member 168 as the cylinder 180 facilitating retrofitting of the tub. When the cover 102 is in the closed position and the kit 200 is installed, the shaft 206*b* of the actuator 206 is in a retracted position, as shown in FIG. 4.

Figure 5:
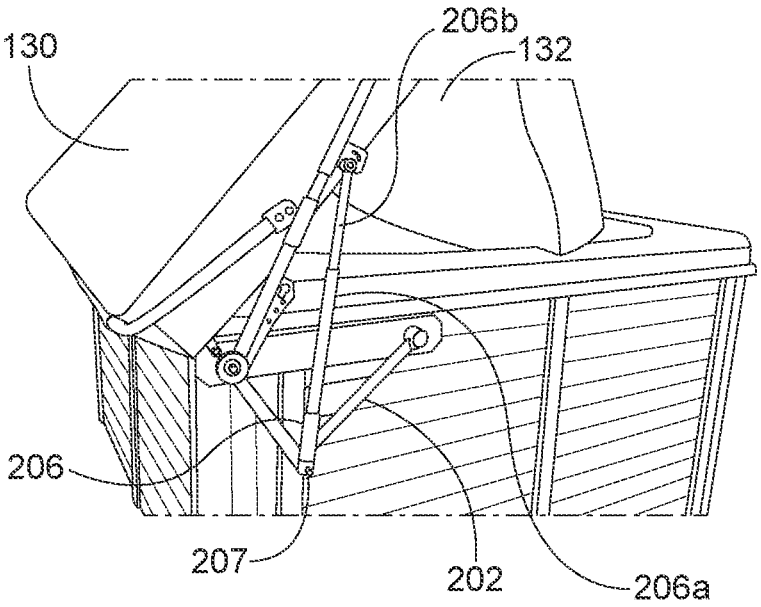
FIG. 5 is a view of the spa tub of FIG. 4 with the cover in an intermediate position.
Figure 6:
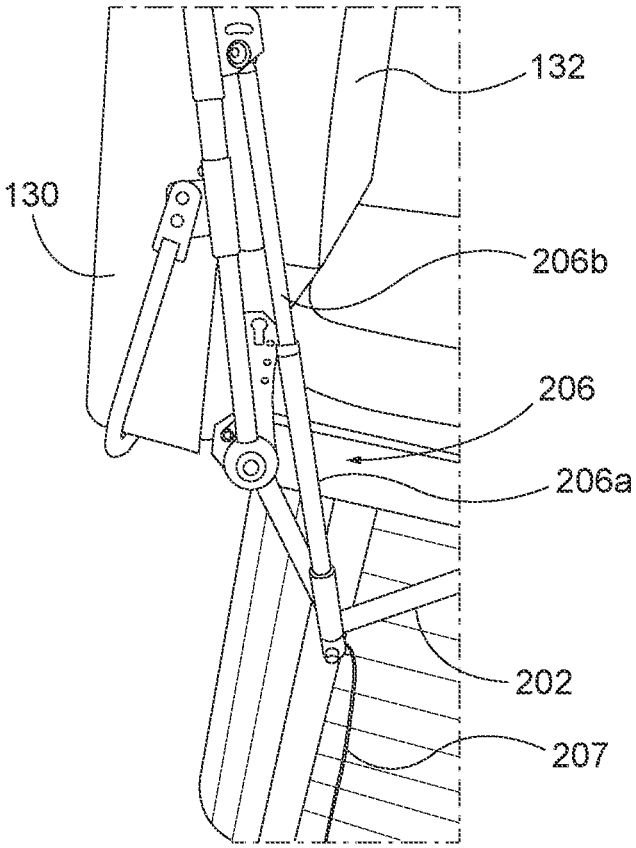
FIG. 6 illustrates the spa tub of FIG. 4 with the cover in a fully open position.

The following operations can be used to open the tub 100 from the closed position shown in FIG. 4 to the open position shown in FIG. 6. A user having the remote controller 210 actuates a control switch (e.g., pushes a button) on the remote controller 210 to open the cover 102. The controller 210 then sends a control signal to the actuator controller 208 to open the cover 102. If the remote controller 210 is a wireless remote controller it must be within communication range of the actuator controller 208 in order for the actuator controller 208 to receive the signal. Upon receipt of the control signal, the actuator controller 208 energizes the actuator 206 to extend the shaft 206*b*, which causes the upper member 168 to begin to rotate (counterclockwise in FIGS. 4 and 6) about axis A2 and causes the cover sections 130 and 132 to fold towards one another about hinge 134 as the hinge 134 is rotated away from the rim of the tub 100, as shown in FIG. 5 with the cover in an intermediate position. If the user continues to actuate the control on the remote controller 210 to further open the cover 102, the actuator controller 208 will continue to energize the actuator 206 to extend the shaft 206*b* to move the cover 102 into the fully open position shown in FIG. 6. Thus, the entire opening operation can be performed completely remotely and without a user manually operating any part of the lifter 104 or the cover 102. Also, as shown in FIGS. 4 to 6, when the cover is between the closed and open positions, the vertex 202*c* remains located horizontally between axes A2 and A3, and vertically below axis A2.

The following operations can be used to close the cover from the open position shown in FIG. 6 to the closed position shown in FIG. 4. A user having the remote controller 210 actuates a control on the controller 210 to close the cover 102. The remote controller 210 then sends a control signal to the actuator controller 208 to close the cover 102. If the remote controller 210 is a wireless remote controller it must be within communication range of the actuator controller 208 in order for the controller 208 to receive the signal. Upon receipt of the command signal, the controller 208 is energized and retracts the shaft 206*b*, which causes the side member 168 to begin to rotate (clockwise in FIGS. 5 and 6) about axis A2 and causes the cover sections 130 and 132 to unfold away from one another about hinge 134, until the lower surface 148 or outer surface 158 of the second portion 132 comes into contact with the rim of the tub. When the lower surface 148 or outer surface 158 of the second portion 132 comes into contact with the rim of the tub, the second portion 132 will extends substantially perpendicular to the rim of the tub and there may be a tendency for the outer side 158 to slide under rather than away from the first portion 130 upon further clockwise rotation of the cover about axis A2. To mitigate this tendency, it may be necessary for a user at this point in the closure operation to pull on the second portion 132 so that it is folded further away from the section 130 to ensure that upon further rotation of side member 168, the second portion 132 will return to its flat, closed position over the tub shown in FIG. 4. Thus, unlike opening the cover 102, to close the cover, a user may need to be in arms reach of the cover to manually guide the second portion 132 along a portion of the rim of the tub 100. Having a user manually involved in some portion of the closure can be beneficial to provide added assurance of a safe closure of the cover (e.g., to mitigate accidentally trapping users who may still be in the tub).

In an embodiment, the following operations can be used to retrofit the tub 100 of FIGS. 2*a* and 2*b* with the kit 200. It is preferable that the cover 102 be positioned in the closed position. Then, a user disconnects the cylinder 180 from the bracket 160 and from upper member 168. Once the cylinder 180 is removed, the arm 202 is connected to the bracket 160 as noted above and shown in FIG. 4. The first end 206*c* of the actuator 206 (e.g., shown in its fully retracted position) is connected to the vertex 202*c* before or after the arm 202 is connected to the bracket 160. The bracket 204 is slid over the upper member 168 and left unsecured thereto. This may be facilitated if there is a break or joint somewhere along the length of the upper member 168 that can be opened to slide the bracket 204 onto and then closed. Then, with the actuator 206 connected only at the first end 206*c*, the actuator 206 is rotated about the vertex 202*c* until the second end 206*d* of the actuator 206 aligns with a mounting location on the bracket 204, at which point the user connects the second end 206*d* to the mounting location on the bracket 204. The bracket 204 is then securely affixed to the side member 168 at the position on the arm set by the actuator 206. The user then locates the controller 208 either outside the cabinet 110 or in the space 118 between the spa shell 108 and the cabinet 110. The controller 208 is then connected to a suitable power supply. The kit 200 can be removed and the tub 100 can be reconverted to fully manual operation by reversing the foregoing operations.

Figure 1A:
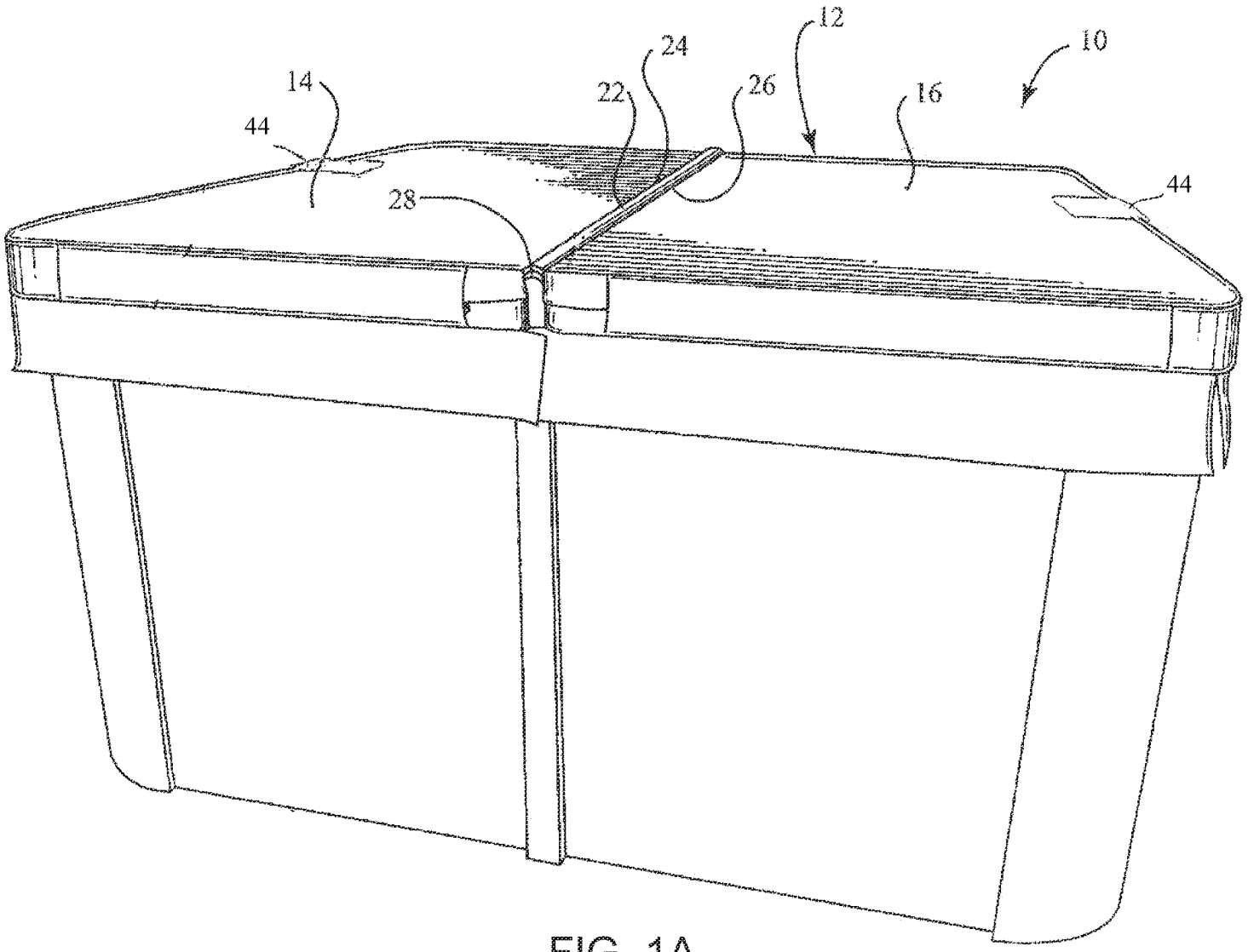
FIG. 1A (Prior Art)
FIG. 1*a* is a side elevation view of a spa tub provided with a prior art insulative cover and lifter system, shown in a closed position.
Figure 1B:
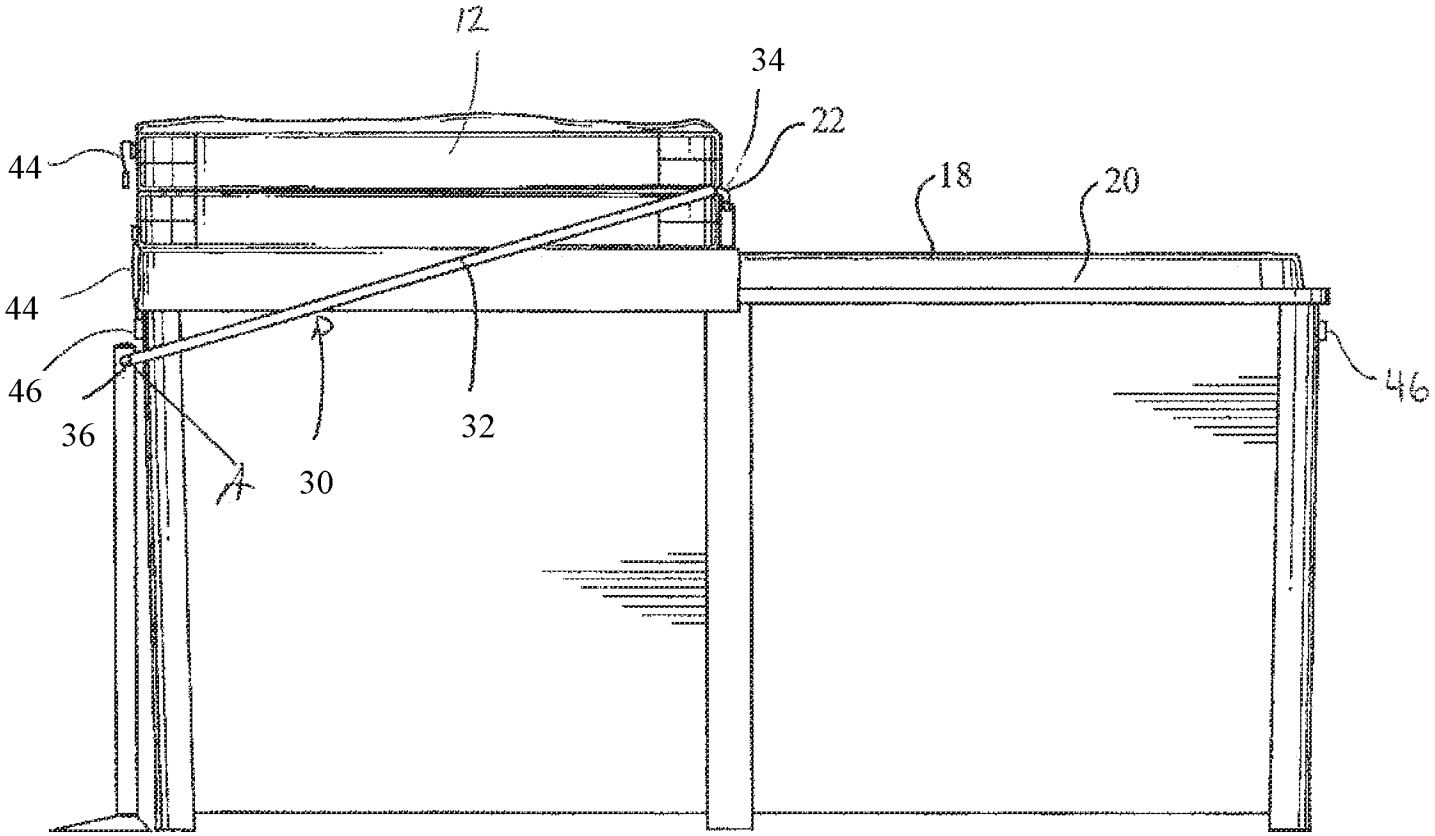
FIG. 1B (Prior Art)
FIG. 1*b* is a side elevation view of a spa tub provided with a prior art insulative cover and lifter system, shown in a partially open position.
Figure 7:
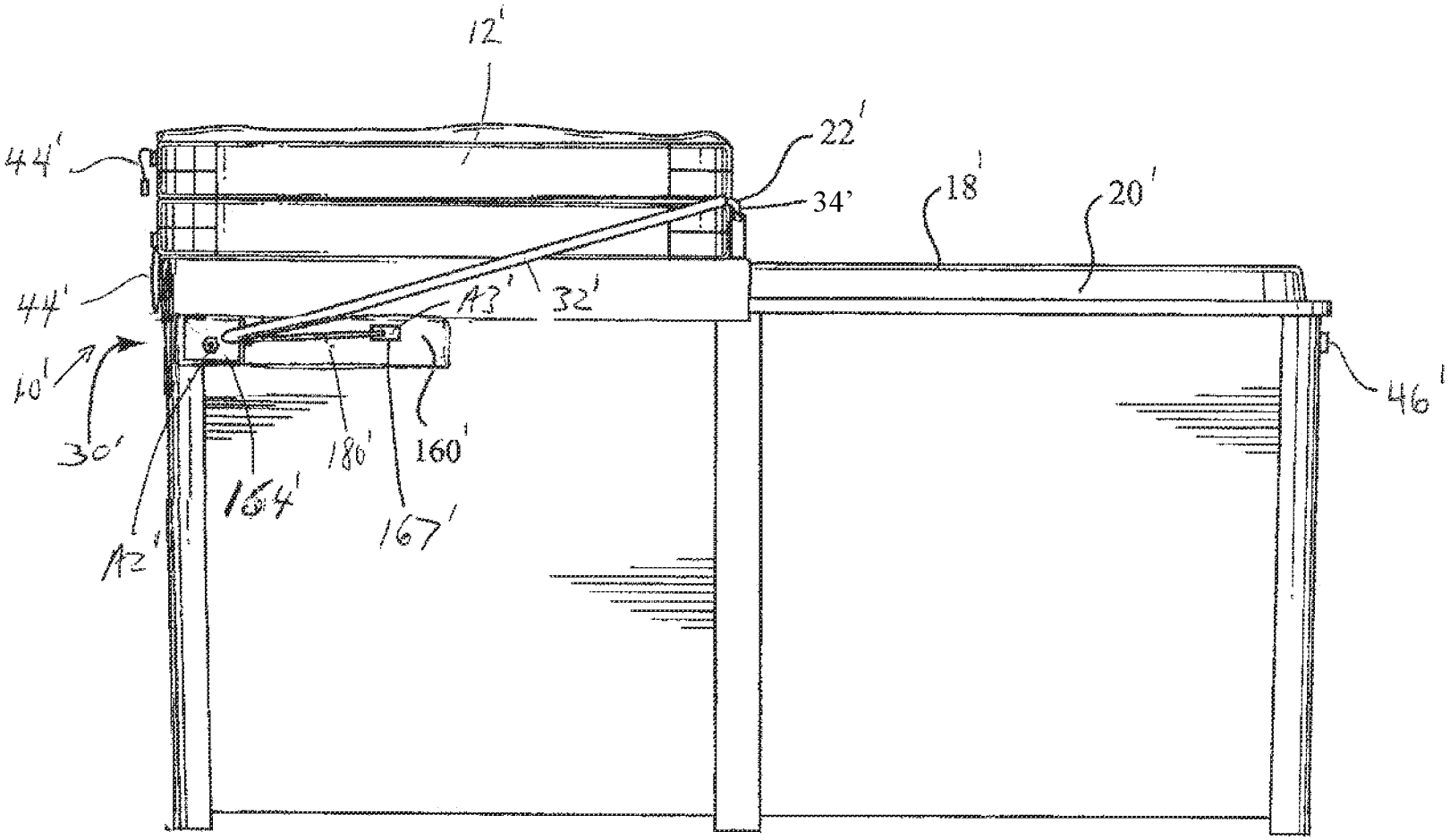
FIG. 7 (Prior Art)
FIG. 7 is a side elevation view of a spa tub provided with a prior art insulative cover and lifter system, shown in a partially open position.
Figure 8:
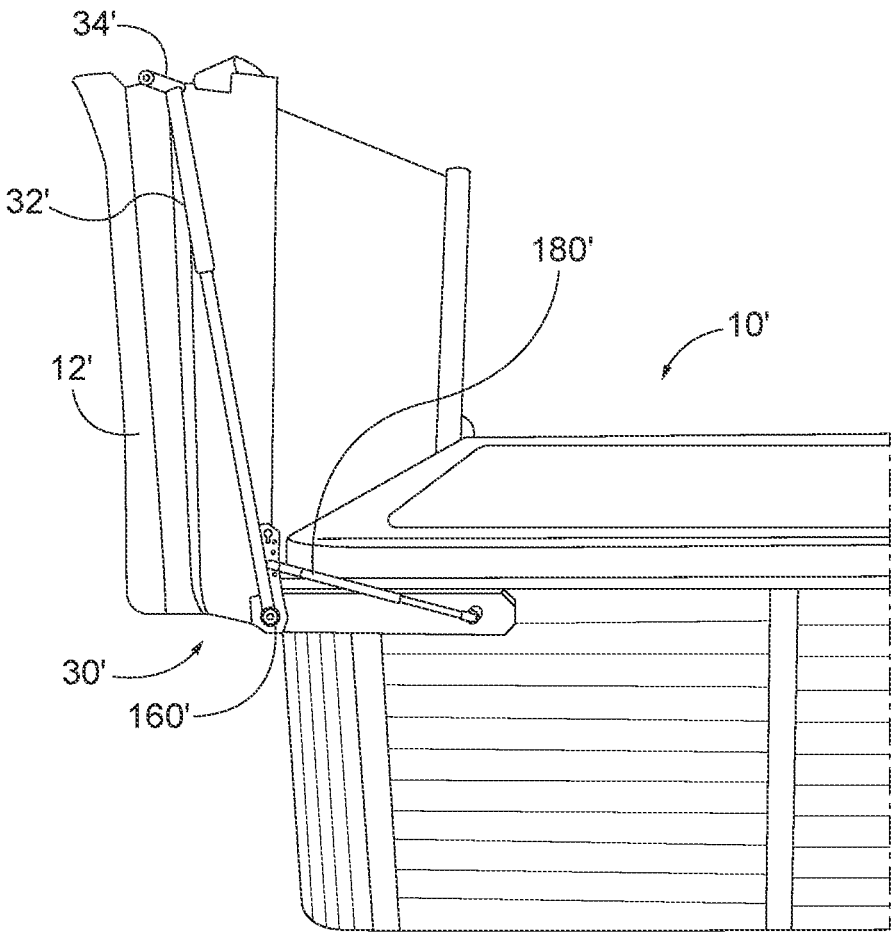
FIG. 8 (Prior Art)
FIG. 8 shows the spa tub of FIG. 7 with the cover in a fully open position.
Figure 9:
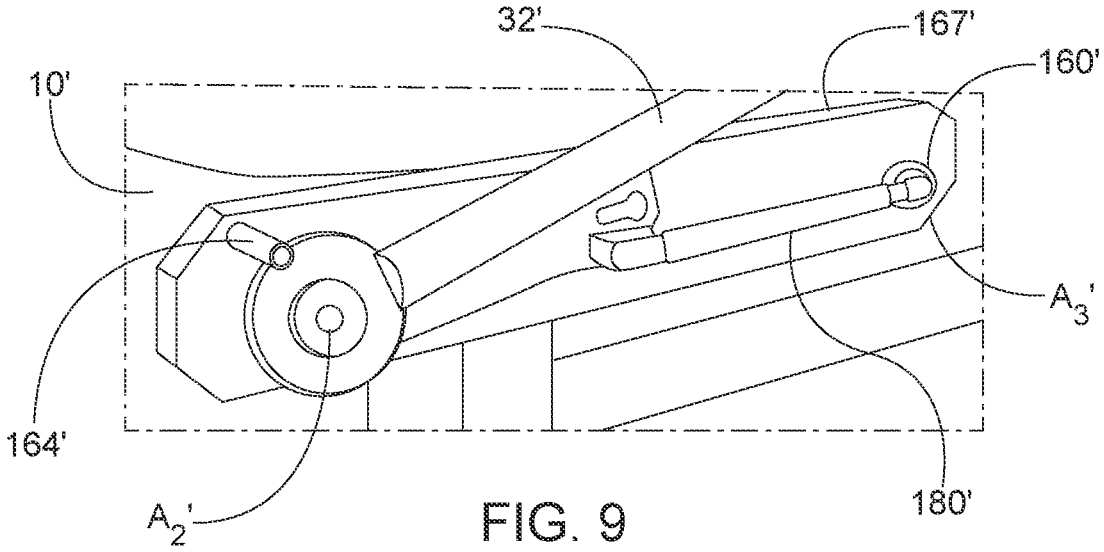
FIG. 9 (Prior Art)
FIG. 9 shows an exploded view of a lifter bracket of the lifter system shown in FIGS. 7 and 8.

FIGS. 7 to 9 show details of another prior art spa tub 10', cover 12', and cover lifter 30'. Specifically, the tub 10' and the cover 12' are the same as the tub 10 and cover 12 shown in FIGS. 1*a* and 1*b*. Elements corresponding to tub 10 and cover 12 are shown in FIGS. 7 to 9 appended with (′). The cover 12' has two portions 14' and 16' of equal size (length and width) connected together by a living hinge 22' that is on an upper surface of the cover 12. Owing to this construction of the cover 12' a lifter different from lifer 104 is used with the cover 12'. Specifically, a lifter 30' is shown in FIGS. 7 to 9 for lifting the cover 12'. The lifter 30' corresponds to lifter 30 described above, but connects to the spa tub 10' with a preexisting bracket 160', which is the same as bracket 160, described above. Elements corresponding to lifer 30 and bracket 160 are shown in FIGS. 7 to 9 appended with (′). Lifter 30' includes a bar 34' extending over the cover 12' between the first and second portions 14' and 16' of the cover 12'. The bar 34' extends over the hinge 22' and is used to fold the second portion 16' over the first portion 14' when opening the cover 12'.

Figure 10:
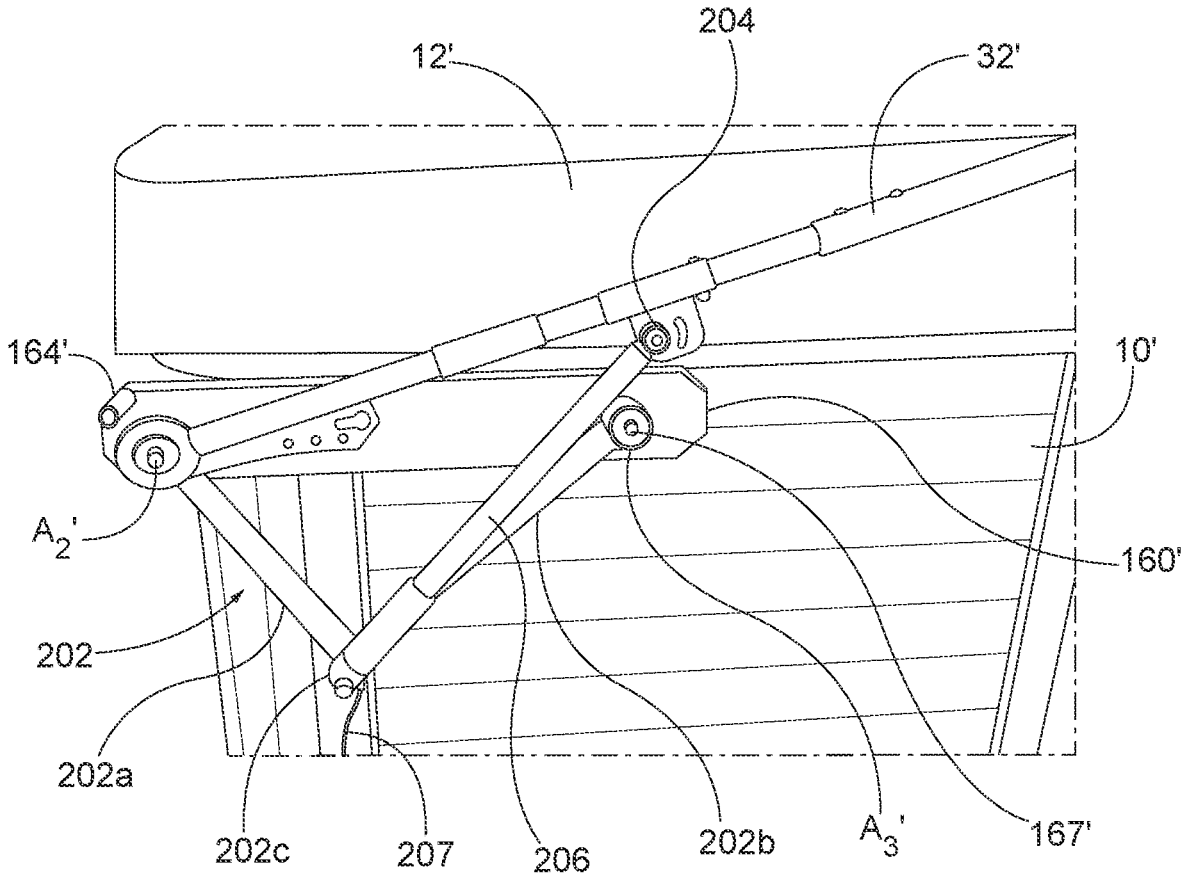
FIG. 10 is view of a portion of the spa tub of FIG. 7 retrofitted with the kit of FIG. 3 with the cover in a closed position.

Preexisting bracket 160', described above, is attached to the sides of the tub 10' along with a cylinder 180'. The cylinder 180' pivotally connects between a second mount 167' defining axis A3' and the side member 32', which is pivotally connected to a first mount 164' defining axis A2'. Because the same bracket 160' is also used on tub 10', the kit 200 described above can be used to retrofit the tub 10' in exactly the same manner described above for tub 100. The tub 10' is shown in FIG. 10 retrofitted with parts of the kit 200 described above.

For example, in an embodiment, the following operations can be used to retrofit the tub 10' of FIGS. 7 and 8 with the kit 200. It is preferable that the cover 12' be positioned in the fully closed position, where both portions 14' and 16' are lying flat across the rim of the tub 10', like the cover 12 shown in FIG. 1*a*. Alternatively, the cover 12' can be folded over the bar 34' as is shown in FIG. 7. Then, a user disconnects the cylinder 180' from the bracket 160' and from side member 32'. Once the cylinder 180' is removed, the angle arm 202 is connected to the bracket 160' as noted above and shown in FIG. 4. Specifically, the boss at the end of the first portion 202*a* of the angle arm 202 is securely connected to mount 164 (e.g., at axis A2') Also, the boss at the end of the second portion 202*b* of the arm is securely connected to mount 167' (e.g., at axis A3'), in the same manner as shown in FIG. 4. Thus, the angle arm 202 is configured to attach universally to the same preexisting locations of the bracket 160'.

The first end 206*c* of the actuator 206 (e.g., shown in its fully retracted position) is connected to the vertex 202*c* of the angle arm 202 before or after the arm 202 is connected to the bracket 160'. The bracket 204 is slid over the side member 32' and left unsecured thereto. This may be facilitated if there is a break or joint somewhere along the length of the side member 32' that can be opened to slide the bracket 204 onto and then closed. Then, with the actuator 206 connected only at the first end 206*c*, the actuator 206 is rotated about the vertex 202*c* until the second end 206*d* of the actuator 206 aligns with a mounting location on the bracket 204, at which point the user connects the second end 206*d* to the mounting location on the bracket 204. The bracket 204 is then securely affixed to the side member 32' at the position on the side member 32' set by the actuator 206. The user then locates the controller 208 either outside the cabinet of the tub 10' or in a space between the spa shell and the cabinet. The controller 208 is then connected to a suitable power supply. The kit 200 can be removed and the tub 10' can be reconverted to fully manual operation by reversing the foregoing operations.

While the same kit 200 can be connected universally to the same bracket attached to two different tubs 100 and 10', it will be appreciated that the universality of the kit 200 may be broadened by modifying the dimensions of certain components of the kit 200 to connect to brackets similar in construction to brackets 160, 160' described herein that connect to preexisting cylinders 180, 180'. For example, other preexisting lifter brackets that attach to spa tubs may have two spaced apart mounting points, which can be used for securely mounting two spaced apart mounting locations of any suitably dimensioned angle arm 202. While the distance between such mounting points on the brackets may not be universal, various angle arms may be produced to accommodate the variation in such spacing between mounting points so that the spacing between the bosses or mounting points at the ends of portions 202*a* and 202*b* match the spacing of the mounting points of the various lifter brackets. In this way, a third mounting point at vertex 202*c* can universally be provided at which to locate an end of the linear actuator 206.

The operations to open and close the cover 12' of retrofitted tub 10' are slightly different from those described above for opening and closing the retrofitted tub 100. Specifically, because the hinge 22' and the lifter bar 34' are on the top surface of the cover 12', it is necessary that the user begin opening the cover 12' by first folding the second portion 16' of the cover 12' over the bar 34' onto the first portion 14'. Then, the user uses the remote controller 210 to actuate a control switch (e.g., pushes a button) on the remote controller 210 to further open the cover 12' into the position shown in FIG. 8. The controller 210 sends a control signal to the actuator controller 208 to open the cover 102. If the remote controller 210 is a wireless remote controller it must be within communication range of the actuator controller 208 in order for the actuator controller 208 to receive the signal. Upon receipt of the control signal, the actuator controller 208 energizes the actuator 206 to extend the shaft 206*b*, which causes the side member 32' to begin to rotate (counter-clockwise in FIG. 7) about axis A2' and causes the folded cover portions 14' and 16' to rotate into the position shown in FIG. 8. Thus, apart from the user folding the second portion 16' over the bar 34' onto the first portion 14' of the cover 12', the rest of the opening operation can be performed completely remotely and without a user manually operating any part of the lifter 30' or the cover 12'.

In accordance with an embodiment, a user can perform the following operations to close the cover 12'. A user having the remote controller 210 actuates a control on the controller 210 to close the cover 12'. The remote controller 210 then sends a control signal to the actuator controller 208 to close the cover 12'. If the remote controller 210 is a wireless remote controller it must be within communication range of the actuator controller 208 in order for the controller 208 to receive the signal. Upon receipt of the command signal, the controller 208 is energized and retracts the shaft 206*b*, which causes the side member 32' to begin to rotate (clockwise in FIG. 8) about axis A2' and cause the cover portions 14' and 16' to move back into a flat position on the tub shown in FIG. 7. Then, the user manually unfolds the second portion 16' away from the first portion 14' (i.e., into the flat position of corresponding second portion 16 shown in FIG. 1*a*) to fully close the tub 12'.

There have been described and illustrated herein several embodiments of a kit for retrofitting a spa tub lifter system and method retrofitting such spa tub lifter systems. While particular embodiments of the invention have been described, it is not intended that the invention be limited thereto, as it is intended that the invention be as broad in scope as the art will allow and that the specification be read likewise.

It will be appreciated that larger spa tubs, such as those known as "swim spas", may use two separate covers, which conventionally manually open independently from the center towards opposite ends of the spa tub. That is, such swim spas generally have two covers with two manual lifters, such as lifters described herein which can be retrofitted as described herein. Each lifter and cover can be retrofitted with a kit as described above. For example, in one embodiment, each of the two lifters may be retrofitted with a corresponding kit 200 so that each of the two covers can be remotely opened and closed. In one embodiment, rather than having one actuator controller 208 and one remote controller 210 corresponding to each cover lifter, a single actuator controller and a single remote controller may be used that is constructed to operate the two pairs of actuators 206 (one pair for each cover) either independently or simultaneously from the single remote controller. Thus, a user can open and close the two covers independently or simultaneously using one remote controller and one actuator controller.

Further, while particular types of linear actuator having certain relative dimensions to the lifter system have been disclosed, it will be appreciated that other linear actuators having different relative dimensions may be used as well with or without dimensional modifications to other portions of the lifter system. In addition, while particular types of controller communication interfaces have been disclosed, it will be understood that any suitable interface can be used. For example, and not by way of limitation, any wired or wireless interface. Also, while a dedicated user remote controller is preferred to be used with the actuator controller, it will be recognized that general remote controllers, such as smart phones, tablet computers, laptop computers, and other remote computing terminals may be used to communicate and control the actuator controller. It will therefore be appreciated by those skilled in the art that yet other modifications could be made to the provided invention without deviating from its spirit and scope as claimed.

What is claimed is:

1. A method of modifying a spa tub cover system for use in association with a preexisting spa tub having a) a spa tub cover including i) a first portion including a first lower surface that faces the water and an opposed first upper surface, ii) a second portion having a second lower surface that faces the water and an opposed second upper surface, wherein said first and second portions rotatable relative to each other on a hinge about a hinge axis between a flat configuration and a folded configuration, and when in said flat configuration, said first and second lower surfaces are co-planar, and b) a lifter system including i) a first bracket fixed relative to the spa tub, ii) a first mount rotatable on said first bracket and defining a first pivot axis, iii) at least one support element rotatable about said first pivot axis and attached to said first spa cover portion, iv) a second mount on said first bracket and defining a second pivot axis, and v) a pneumatic cylinder, piston, or spring pivotally attached to said at least one support element and said second mount; said method comprising the steps of:

providing a kit that includes an angle arm configured to attach to the first bracket, a support element bracket configured to fixedly attach to said support element, a linear actuator configured to extend and retract and configured to pivotally attach to said angle arm and said support element bracket, an actuator controller configured to control extension and retraction of said linear actuator; and disconnecting the pneumatic cylinder, piston, or spring from said at least one support element and said second mount;

securing said angle arm to said first mount and said second mount;

securing said support element bracket to said support element;

pivotally connecting said linear actuator to said angle arm and to said pivotal mounting of said support element bracket; and connecting said linear actuator to an electrical power source.

2. The method according to claim 1, wherein:

said angle arm includes a first portion and a second portion extending from a common vertex at a fixed nonzero angle relative to one another, wherein said first portion extends from said vertex to a first end and said second portion extends from said vertex to a second end, and wherein said vertex defines a third pivot axis, and wherein securing said angle arm to said first mount and said second mount includes attaching said first end of said first portion to said first mount and attaching said second end of said second portion to said second mount so that said vertex is disposed horizontally between said first and second mounts and between said first and second axes and said vertex is disposed vertically below said first axis.

3. The method according to claim 2, wherein:

said pivotally connecting one of said linear actuators includes pivotally connecting an end of said linear actuator to said vertex of said angle arm for rotation of the linear actuator about said third pivot axis.

4. The method according to claim 1, wherein:

said providing said kit step includes providing a remote controller configured to control said actuator controller wherein said provided remote controller and actuator controller communicate with one another via a wired or wireless connection.

5. The method according to claim 1, wherein:

said providing said kit step includes providing a kit with two angle arms configured to attach to respective first brackets on opposite sides of the spa tub, two support element brackets configured to fixedly attach to said support elements on opposite sides of the spa tub, two linear actuators configured to pivotally attach to said respective angle arms and said support element brackets on opposite sides of the spa tub, and wherein said actuator controller is configured to operate said two linear actuators in unison.

6. The method according to claim 1, further comprising:

configuring the cover wherein the first and second portions are in the flat configuration, and wherein said linear actuator is in a retracted position when connected between said angle arm and said support element bracket.

7. A kit for modifying a spa tub cover system for use in association with a spa tub that has a) a spa tub cover including i) a first portion having a first lower surface that faces the water and an opposed first upper surface, ii) a second portion having a second lower surface that faces the water and an opposed second upper surface, wherein said first and second portions rotatable relative to each other on a hinge about a hinge axis between a flat configuration and a folded configuration, and when in said flat configuration, said first and second lower surfaces are co-planar, and b) a lifter system including i) a first bracket located relative to the spa tub, ii) a first mount rotatable on said first bracket and defining a first pivot axis, iii) at least one support element rotatable about said first pivot axis and adapted to support said spa tub cover, iv) a second mount on said first bracket and defining a second pivot axis, and v) a pneumatic cylinder, piston, or spring pivotally attached to said at least one support element and said second mount; said kit comprising:

an angle arm configured to attach to the first bracket;

a support element bracket configured to fixedly attach to said support element;

an electrically powered linear actuator configured to extend and retract and configured to pivotally attach to said angle arm and said support element bracket; and an actuator controller configured to control extension and retraction of said linear actuator.

8. The kit according to claim 7, wherein:

said angle arm includes a first portion and a second portion extending from a common vertex at a fixed nonzero angle relative to one another, wherein said first portion extends from said vertex to a first end and said second portion extends from said vertex to a second end, and wherein said vertex defines a third pivot axis, and wherein said first end of said first portion is configured to connect to said first mount and said second end of said second portion is configured to connect to said second mount so that said vertex is disposed horizontally between said first and second mounts and between said first and second axes and said vertex is disposed vertically below said first axis.

9. The kit according to claim 8, wherein:

an end of said linear actuator is configured to pivotally connect to said vertex of said angle arm.

10. The kit according to claim 8, further comprising:

a remote controller configured to control the actuator controller, wherein said remote controller and actuator controller are configured to communicate with one another via a wired or wireless connection.

11. The kit according to claim 8, wherein:

said kit includes two angle arms configured to attach to respective first brackets on opposite sides of the spa tub, two support element brackets configured to fixedly attach to said support elements on opposite sides of the spa tub, two linear actuators configured to pivotally attach to corresponding angle arms and said support element brackets on opposite sides of the spa tub, and wherein said actuator controller is configured to operate said two linear actuators in unison.

12. The kit according to claim 8, wherein:

said linear actuator is configured to extend or retract when power is applied to the said linear actuator and wherein said linear actuator is configured not to extend or retract when power is not applied to said linear actuator.

13. In a spa tub cover system for use in association with a spa tub having a spa tub cover including i) a first portion having a first lower surface that faces the water and an opposed first upper surface, ii) a second portion having a second lower surface that faces the water and an opposed second upper surface, wherein said first and second portions rotatable relative to each other on a hinge about a hinge axis between a flat configuration and a folded configuration, and when in said flat configuration, said first and second lower surfaces are co-planar, the improvement comprising:

a lifter system including:

i) a first bracket fixed relative to the spa tub, ii) a first mount rotatable on said first bracket and defining a first pivot axis, iii) at least one support element rotatable about said first pivot axis and attached to said first spa cover portion, iv) a second mount on said first bracket and defining a second pivot axis, v) an angle arm having a first portion and a second portion connected at a vertex, the first portion attached to the first mount and the second portion attached to the second mount, vi) a support element bracket fixedly attached to said support element, vii) an electrically powered linear actuator configured to extend and retract and pivotally attached to said vertex of said angle arm and said support element bracket, and viii) an actuator controller coupled to and configured to control extension and retraction of said linear actuator.

14. The system according to claim 13, wherein said lifter system further comprises:

a remote controller configured to control the actuator controller to extend or retract, and wherein said remote controller and actuator controller are configured to communicate with one another via a wired or wireless connection.

15. The system according to claim 13, wherein:

said lifter system includes two angle arms configured to attach to respective the supports on opposite sides of the spa tub, two support element brackets configured to fixedly attach to said support elements on opposite sides of the spa tub, two linear actuators configured to pivotally attach to corresponding angle arms and said support element brackets on opposite sides of the spa tub, and wherein said actuator controller is configured to operate said two linear actuators in unison.

16. The system according to claim 13, wherein:

said linear actuator is configured to extend or retract when power is applied to the said linear actuator and wherein said linear actuator is configured not to extend or retract when power is not applied to said linear actuator.

17. A method of operating the spa tub cover lifting system according to claim 13, said method comprising:

receiving a control signal at said actuator controller to open said cover; and in response to receiving said control signal, automatically applying power to said linear actuator to cause the linear actuator to extend to cause said at least one support element to rotate about said first pivot axis and thereby lift said cover off of said spa tub;

receiving a control signal at said actuator controller to close said cover; and in response to receiving said control signal, automatically applying power to said linear actuator to cause the linear actuator to retract to cause said at least one support element to rotate about said first pivot axis and thereby lower said cover onto said spa tub.

* * * * *